United States Patent [19]

Guevel et al.

[11] Patent Number: 4,840,021

[45] Date of Patent: Jun. 20, 1989

[54] CONTINUOUS MULTIFILAMENT SEWING THREAD AND PROCESS FOR MAKING SAME

[75] Inventors: Jean Guevel, Viriat; Marc Francois, Ecully; Guy Bontemps, Tenay, all of France

[73] Assignee: Sa Schappe, Saint Rambert en Bugey, France

[21] Appl. No.: 158,456

[22] Filed: Feb. 22, 1988

[30] Foreign Application Priority Data

Feb. 20, 1987 [FR] France ..... 87 02869

[51] Int. Cl.[4] ..... D02G 3/28; D02G 3/04

[52] U.S. Cl. ..... 57/210; 57/6; 57/224

[58] Field of Search ..... 57/3, 6, 13, 15, 210, 57/224, 225, 226, 243, 244, 315

[56] References Cited

U.S. PATENT DOCUMENTS

| | | | |
|---|---|---|---|
| 2,449,595 | 9/1948 | Ellis | 57/224 X |
| 2,477,652 | 8/1949 | Robbins | 57/210 X |
| 2,526,523 | 10/1950 | Weiss | 57/210 |
| 3,013,379 | 12/1961 | Breen | 57/226 X |
| 3,410,078 | 11/1968 | Freedman et al. . | |
| 3,609,953 | 10/1971 | Kitawaza | 57/226 |
| 4,018,042 | 4/1977 | Maag et al. | 57/210 |
| 4,069,656 | 1/1978 | Arai | 57/210 X |
| 4,484,433 | 11/1984 | Stahlecker et al. | 57/210 X |

FOREIGN PATENT DOCUMENTS

| | | |
|---|---|---|
| 0100192 | 2/1984 | European Pat. Off. . |
| 1201221 | 9/1965 | Fed. Rep. of Germany . |
| 3148940 | 6/1983 | Fed. Rep. of Germany . |

*Primary Examiner*—Donald Watkins

*Attorney, Agent, or Firm*—Browdy and Neimark

[57] ABSTRACT

A sewing thread, whose twist factor is between 100 and 150, consists essentially of a fixed high-tenacity multifilament core, sheathed with a cover of staple fibers, the unit being wrapped with a multifilament yarn. The process of spinning this sewing thread is performed on a spinning frame. The core yarn and the roving of staple fibers are brought to drawing rolls in the drawing plane, and wrapping yarn is brought to the drawing rolls in an offset manner relative to the spinning plane.

4 Claims, 1 Drawing Sheet

CONTINUOUS MULTIFILAMENT SEWING THREAD AND PROCESS FOR MAKING SAME

BACKGROUND OF THE INVENTION

1. Field of the Invention

This invention relates to a continuous multifilament sewing thread and a process for making it.

2. The Prior Art

It is known that standard sewing threads with a base of fiber yarns are made by assembly of several fiber yarns which receive an S twist, the assembly being made in the Z direction.

To be high-performing on the technical plane, a sewing thread must exhibit a cross-section which is as close as possible to a circular section.

For this reason, originally and as can be seen in FIG. 3 of the accompanying drawing, the sewing threads comprised up to five assembled fiber yarns. This considerable number could be reduced, principally for economic reasons aimed at reducing production costs, to two or three yarns, as represented in FIGS. 1 and 2.

This production simplification still remains only a relative simplification; production of a sewing thread conventionally requires a considerable number of steps listed below. The steps involved in preparation of single fiber yarns include:

(1) stretch breaking;
(2) drawing/mixing;
(3) roving frames;
(4) spinning;
(5) winding/clearing;
(6) then assembly of these fiber yarns;
(7) twisting;
(8) winding under tension;
(9) fixing;
(10) gassing;
(11) scraping; and
(12) checking and splicing.

Since it is known that the ideal section of a sewing thread is a circular section and the single fiber yarns exhibit this section, it might be possible to avoid all assembly operations and use only single fiber yarns. However, this has not proved possible and numerous tests in this direction have led to failure, the causes of which can be summarized as follows:

(a) too weak mechanical strength;
(b) abrasion of the fibers in the eye of the needle; and
(c) dimensional instability due to the impossibility of performing the tension and fixing operation essential for a 100% fiber yarn.

SUMMARY OF THE INVENTION

Therefore, the object of the invention is to remedy the drawbacks of the prior art by proposing a multifilament core sewing thread whose sewability and strength are equivalent to those sewing threads obtained by assembly of fiber yarns and which further can be obtained by a very simplified production process in comparison with processes used so far.

The sewing thread according to the invention is made up essentially of a fixed high-tenacity multifilament core, sheathed with a covering of stretch-broken or cut fibers, the unit being wrapped by a multifilament yarn.

Both the filament part and the stretch broken or cut fibers can be made from any known textile material, whether natural fibers, artificial fibers or synthethic fibers.

Still other objects, features and attendant advantages of the present invention will become apparent to those skilled in the art from a reading of the following detailed description of the embodiments constructed in accordance therewith, taken in conjunction with the accompanying drawings.

BRIEF DESCRIPTION OF THE DRAWINGS

The invention of the present application will now be described in more detail with reference to the preferred embodiments of the device, given only by way of example, and with reference to the accompanying drawings, in which.

DETAILED DESCRIPTION OF THE PREFERRED EMBODIMENT

In the figures, the thread according to the invention is represented generally by 2, and is essentially made up of a core 3, a cover 4 and a wrapping 5.

Figure 5:
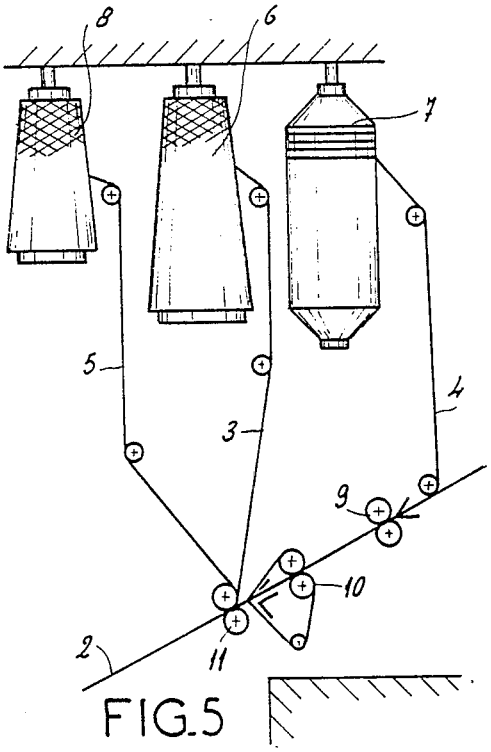
FIG. 5 is a diagrammatic view, in cross section, of a part of the spinning system of the yarn thread according to the present invention.
Figure 6:
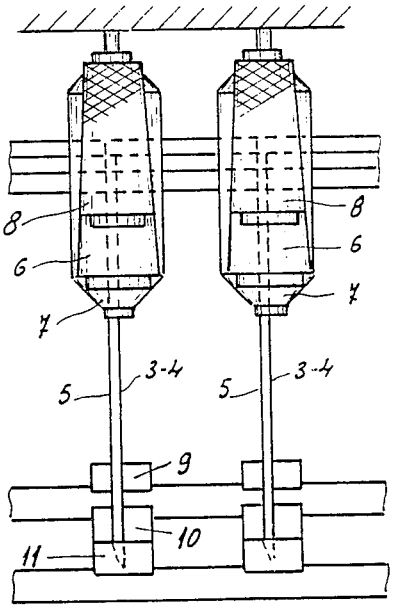
FIG. 6 is a left view of FIG. 5, representing a pair of spindles.

Spinning is performed on a standard spinning frame for core yarn of the type currently known as "core spun"; however, this spinning frame has been modified, according to the present invention, by addition of a feed device 8 for feeding wrapping yarn 5, as can be seen in FIGS. 5 and 6.

The diagram of the spinning process will now be explained with reference to FIGS. 5 and 6.

After having undergone the operations of stretch breaking, drawing/mixing and passage on the roving frame (not shown in the drawing), the roving of fibers 4, coming from bobbin 7, passes between feed rolls 9, then between intermediate rolls 10, before coming to drawing rolls 11. Core yarn 3, fed by bobbin 6, is also brought to these drawing rolls 11, in the drawing plane, like fiber roving 4. Thread 2 thus obtained is subjected to the standard operations of winding, clearing and splicing, not shown in the drawing.

Finally, and according to the invention, a wrapping yarn 5, fed by bobbin 8, also coming to drawing rolls 11, but in an offset manner relative to the drawing plane, as can be seen well in FIG. 6.

Figure 1:
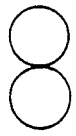
FIG. 1 is a cross-sectional view of the conventional thread consisting of two fiber yarns.
Figure 2:
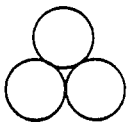
FIG. 2 is a cross-sectional view of the conventional thread consisting of three fiber yarns.
Figure 3:
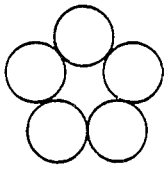
FIG. 3 is a cross-sectional view of the conventional thread consisting of five fiber yarns.
Figure 4:
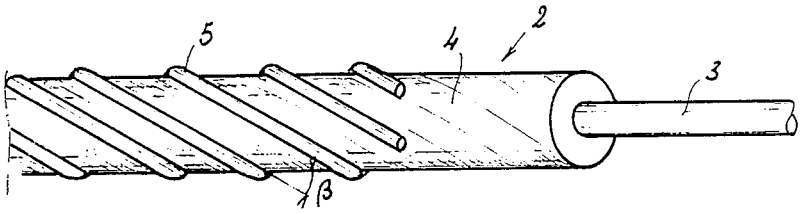
FIG. 4 is a diagrammatic perspective view, partially broken away, of the sewing thread according to the present invention present.

Thus a yarn is obtained as diagrammatically represented in FIG. 4.

It is quite clear, and this is part of the invention, that the angle of inclination of the fibers has a fundamental importance. This angle $\beta$, governs the degree of closing of yarn 2 and, consequently, the binding of fibers 4 of the cover by wrapping filament or yarn 5.

This angle $\beta$, is a linear function of the twist of the yarn.

If T is the twist in turns per meter,

Mn is the metric number, and $\alpha$ is the twist factor $$T=\alpha\sqrt{Mn}$$

and $\beta=f(\alpha, Mn)$, is therefore a function of two independent variables.

For each metric number, the value of Mn quite evidently becomes constant and we have:

$\beta=f(\alpha)$, which indeed is a linear function.

The numerous tests made by the applicant made it possible to determine that $\alpha$, should be between 100 and 150.

This high level of twist factor does not cause significant loss of physical characteristics of the yarn. The multifilaments actually maintain a stronger residual strength than the fiber yarns.

The mechanical strength of thread 2 is imparted to it in great part by core yarn 3. Cover yarns 4 notably add to this strength and the main function of wrapping yarn 5 is to lock the staple fibers of cover 4 to cancel their corrosion during passage in the eye of the sewing needle.

EXAMPLE

A sewing thread is made from the following elements according to the process described above:

core filaments 3: 24.6% 74 dtex Trevira T712 fixed wrapping filaments 5: 16.6% 50 dtex Trevira T712 fixed cover filaments 4: 58.8% fibers brilliant Trevira T 132, 3.1 dtex $\alpha=130$ Mn=33.3 (equivalent to 100/3)

twist $T=130\sqrt{33.1}=750$ S direction

The following table compares the properties of the threaded thus obtained to the standard sewing thread:

| | standard 100/3 | Invention 33.3/1 |
|---|---|---|
| twist | 850 S/750Z | 750 S |
| Skm | 45 | 45.5 |
| A % | 12 | 11.5 force |
| Average | 1350 cN | 1366 cN |
| Shrinkage 180° C. | | |
| Dry air | 3% | 3.5% |

A remarkable equality of the various parameters can be noted.

Further, sewability tests on the machine also give comparable results.

Thus, a thread is obtained comparable in every respect with the best sewing threads, but with a process that is much more economical to use, since, instead of a dozen successive operations required in the standard system and listed above, its production requires only the five following operations:

(1) stretch breaking;
(2) drawing/mixing;
(3) roving frames;
(4) spinning; and
(5) winding/clearing/splicing.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

What is claimed is:

1. Multifilament core sewing thread, comprising:

a fixed high-tenacity multifilament core;

a cover sheathing said core, made of staple fibers; and a multifilament yarn wrapping said core and said cover, wherein said multifilament yarn wrapping said core and said cover has the same rate of torsion as said core and said cover.

2. The sewing thread according to claim 1, wherein said thread has a twist factor between 100 and 150.

3. A process of making sewing thread having a fixed high-tenacity multifilament core, a cover surrounding said core and a multifilament yarn for wrapping said cover core, comprising the steps of:

(a) stretch breaking a ribbon of yarn, (b) drawing and blending of fibers thus obtained, (c) passing said fibers on roving frames, (d) spinning and (e) winding, clearing and splicing, wherein the wrapping yarn has the same rate of torsion as the core filament and the cover.

4. The process of making a sewing thread according to claim 3, wherein said process is performed on a spinning frame, said core and the roving of staple fiber cover being fed to drawing rolls in a drawing plane, said wrapping yarn being fed to said drawing rolls in an offset manner relative to a spinning plane.

* * * * *